US007497360B2

(12) United States Patent
Sweeton

(10) Patent No.: US 7,497,360 B2
(45) Date of Patent: Mar. 3, 2009

(54) BATTERY POWERED SOLENOID ACTUATED LIQUID TAP DISPENSER HAVING OPTIONAL MANUAL ACTUATION

(75) Inventor: Steve L. Sweeton, Lake Winnebago, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 591 days.

(21) Appl. No.: 11/082,402

(22) Filed: Mar. 17, 2005

(65) Prior Publication Data

US 2006/0208008 A1 Sep. 21, 2006

(51) Int. Cl.
*B67D 3/00* (2006.01)

(52) U.S. Cl. ..... 222/504; 141/192

(58) Field of Classification Search ..... 222/504, 222/691, 105, 60–62, 129.3, 145.5, 641, 222/129.1, 1, 52, 63; 141/277, 69, 198, 95, 141/361, 367, 192–121, 362, 227
See application file for complete search history.

(56) References Cited

U.S. PATENT DOCUMENTS

| | | | | | |
|---|---|---|---|---|---|
| 1,149,256 | A | * | 8/1915 | Godfrey | 141/227 |
| 2,919,726 | A | * | 1/1960 | Zimmermann et al. | 141/69 |
| 3,200,997 | A | * | 8/1965 | Creswick | 222/145.5 |
| 3,625,402 | A | * | 12/1971 | Kulis | 222/129.3 |
| 4,236,553 | A | * | 12/1980 | Reichenberger | 141/198 |
| 4,450,987 | A | * | 5/1984 | Boettcher et al. | 222/641 |
| 4,753,277 | A | * | 6/1988 | Holcomb et al. | 141/95 |

* cited by examiner

*Primary Examiner*—Lien T Ngo

(57) ABSTRACT

A battery powered solenoid actuated liquid tap dispenser has a solenoid coil, an armature extending through the coil, a valve seal coupled to the armature, a spout engaged by the valve seal, an electrical actuation button adjacent to the spout, and a manual actuation button atop the armature. The electrical actuation button is arranged to be engaged by the lip of a cup placed under the spout and cause the armature to move in the coil thereby moving the valve seal away from the spout. Alternatively, the armature may be moved by the manual actuation button.

7 Claims, 6 Drawing Sheets

FIG 8
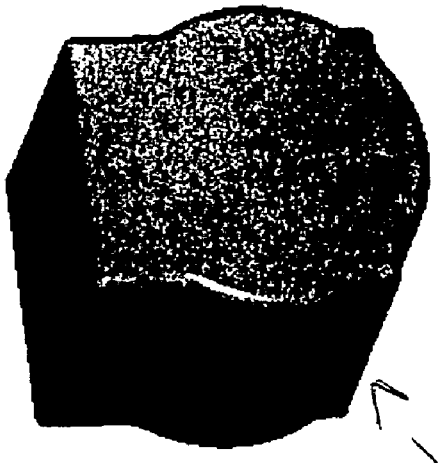
50
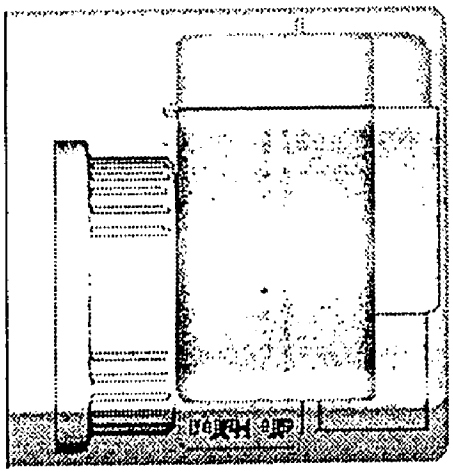
FIG. 9

BATTERY POWERED SOLENOID ACTUATED LIQUID TAP DISPENSER HAVING OPTIONAL MANUAL ACTUATION

BACKGROUND OF THE INVENTION

1. Field of the Invention

This invention relates broadly to liquid dispensers. More particularly, this invention relates to a combination battery powered and manually operable liquid tap dispenser.

2. State of the Art

It is difficult to dispense liquid from a large container such as a large jug or a barrel to a smaller container such as a cup because the large containers are often too heavy to be lifted like a bottle. Traditionally, liquids have been dispensed from large containers via a "tap", i.e. a valved spout located at or near the bottom of the container. The user places or holds a cup under the spout and opens the valve. When the cup is filled to the desired level, the valve is closed. Sometimes, a tap is arranged over a surface so that the user can place the cup on the surface and then operate the valve with one hand without having to hold the cup with the other hand. Other times the tap is arranged at the edge of a table where there is no surface close enough to the tap to place the cup. In these arrangements, the user must hold the cup under the tap with one hand while operating the valve with the other hand.

There are known beverage dispensers which have tap valves coupled to a lever which extends down behind the spout. The user holds a cup under the spout and pushes the lever forward with the cup to activate the tap valve. One problem with these taps is that the liquid dispensed from the tap sometimes spills onto the user's hand.

Recently there has been a trend to provide large liquid detergent containers with a tap dispenser. These containers typically sit on a shelf or a table in a laundry room with the tap extending over the edge of the shelf or table. As such, the lever arrangement of beverage dispensers cannot be implemented because the table/shelf edge would impede movement of a lever.

SUMMARY OF THE INVENTION

It is therefore an object of the invention to provide a liquid dispenser of the tap type.

It is another object of the invention to provide a tap dispenser which can be operated with one hand.

It is a further object of the invention to provide a tap dispenser which can be used with a container that sits on a shelf or table with the tap spout overlying the edge of the shelf or table.

It is also an object of the invention to provide a tap dispenser for liquid laundry detergent.

It is an additional object of the invention to provide a battery operated tap dispenser.

It is still another object of the invention to provide a battery operated tap dispenser which has a manual operational mode.

In accord with these objects, which will be discussed in detail below, the liquid dispenser according to the invention includes a first cylinder which is adapted to fit in place of existing liquid laundry detergent taps, a second cylinder having an axis orthogonal to the axis of the first cylinder, and a fluid passage coupling the two cylinders. A solenoid coil is mounted inside the second cylinder and is provided with an armature rod having upper and lower ends. The upper end of the armature rod is coupled to a cylindrical pushbutton which is biased upward inside the second cylinder by a coil spring surrounding the solenoid coil. The lower end of the armature rod is coupled to a conical valve seal and is therefore biased by the same coil spring against the bottom of the second cylinder which acts as a spout. A rectangular opening extends through the fluid passage between the two cylinders. A rectangular pushbutton coupled to a normally-off microswitch is disposed inside the rectangular opening with the rectangular pushbutton extending out of the rectangular opening behind the spout. A battery compartment is arranged on top of the fluid passage between the two cylinders. The batteries are coupled via the normally-off microswitch to the solenoid coil.

To use the dispenser, one holds a cup under the spout and lifts the cup vertically until the lip of the cup presses the rectangular pushbutton up so that it activates the microswitch. The switch in turn actuates the solenoid coil which causes the armature to move down against the coil spring thereby moving the conical valve seal away from the bottom of the second cylinder and allowing liquid to exit the spout through the action of gravity. When the cup is moved vertically down away for the rectangular pushbutton, the microswitch is deactivated, and in turn the solenoid coil is deactivated and the coil spring returns the conical seal back to the closed position, thereby preventing liquid flow. At any time, and particularly if the batteries become too weak to power the solenoid, the cylindrical pushbutton at the top of the armature can be used to manually operate the tap, albeit with two hands rather than one.

Additional objects and advantages of the invention will become apparent to those skilled in the art upon reference to the detailed description taken in conjunction with the provided figures.

BRIEF DESCRIPTION OF THE DRAWINGS

FIG. 8 is a perspective view of a cap for covering the dispenser when the dispenser is attached to a container filled with liquid prior to sale; and FIG. 9 is a partially transparent side elevation view of the cap covering the dispenser.

DETAILED DESCRIPTION OF THE PREFERRED EMBODIMENTS

Turning now to FIGS. 1-4, 6 and 7, a liquid dispenser 10 according to the invention includes a first internally threaded cylinder 12 which is adapted to couple to a liquid container (e.g. to fit in place of an existing liquid laundry detergent tap), a second cylinder 14 having an axis orthogonal to the axis of the first cylinder, and a fluid passage 16 coupling the two cylinders. The fluid passage 16 is seen best in FIGS. 4 and 7.

Figure 4:
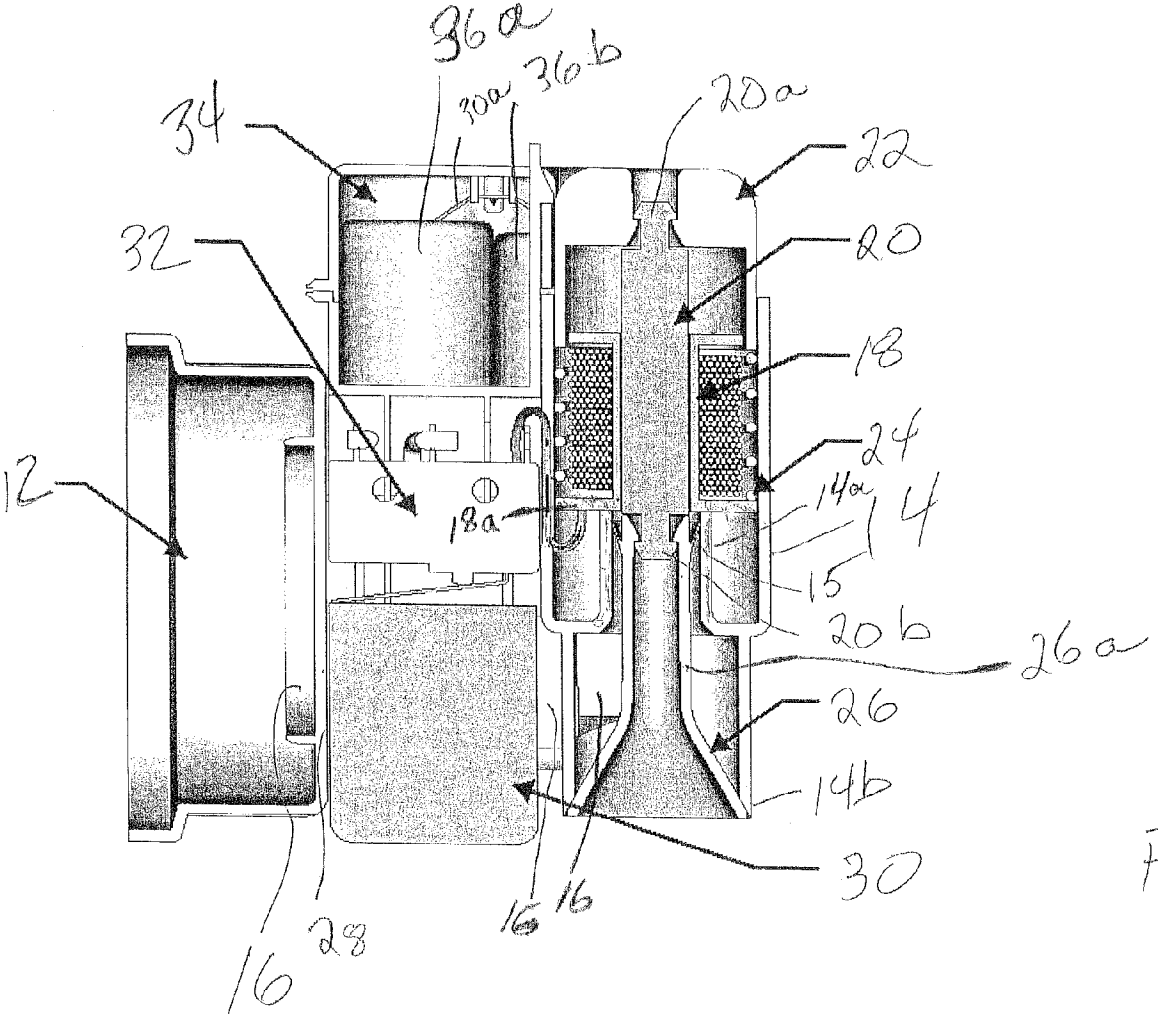
FIG. 4 is a side sectional view of the dispenser with the valve closed.
Figure 6:
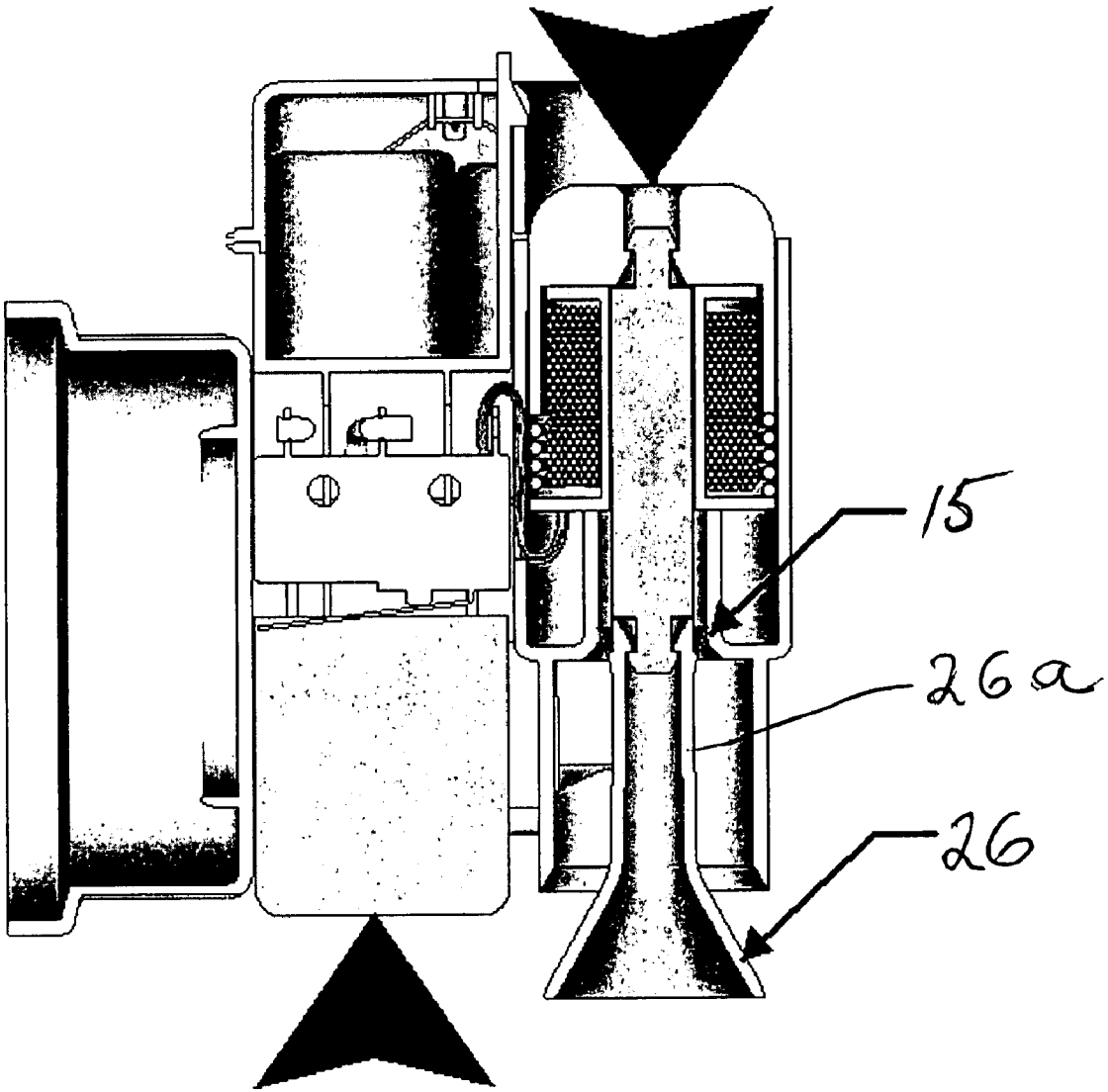
FIG. 6 is a side sectional view of the dispenser with the valve open.
Figure 7:
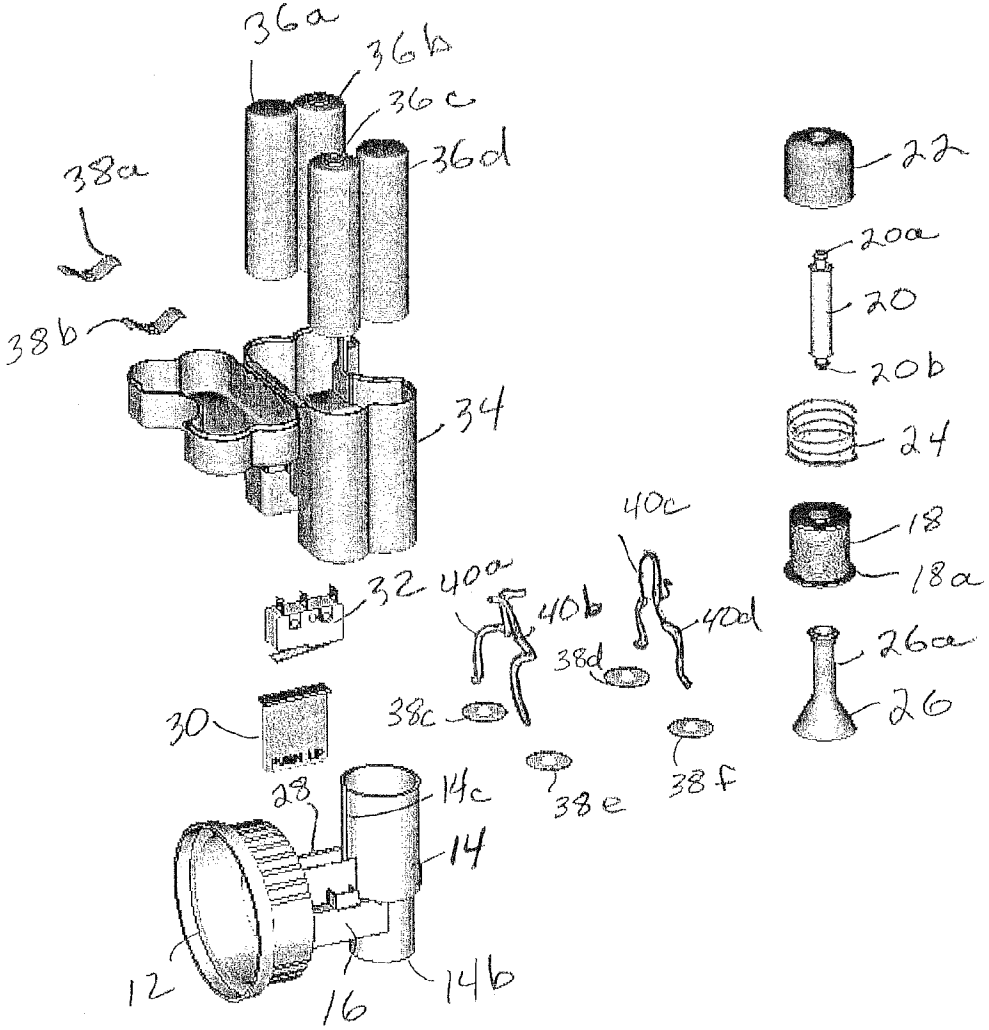
FIG. 7 is an exploded perspective view of the dispenser illustrating all of the component parts.

As seen best in FIGS. 4 and 6, a solenoid coil 18 is mounted inside the cylinder 14 over an annular wall 14*a* and is provided with an armature rod 20 having upper and lower frustroconical coupling ends 20*a*, 20*b*. The upper end 20*a* of the armature rod 20 is coupled to an annular cylindrical pushbutton 22 which is biased upward inside the cylinder 14 by a coil spring 24 surrounding the solenoid coil 18 and supported by an annular wall 18*a* on the bottom of the solenoid 18. The lower end 20*b* of the armature rod 20 is coupled to a conical valve seal 26 via the valve's stem 26*a* which extends from the apex of the conical valve seal. Since the pushbutton 22 is coupled to the armature rod 20, when it is biased upward by the spring 24 the armature rod 20 is also biased upward. Since the valve seal 26 is coupled to the armature rod 20 by the valve seal stem 26*a*, when the armature rod 20 is biased upward, the valve seal 26 is also biased upward against the bottom 14*b* of the cylinder 14 which acts as a spout. It will be appreciated that the annular wall 14*a* lies above the fluid passage 16 and thus somewhat isolates the solenoid coil 18 from fluid. In addition, a dynamic seal 15 is provides in the annular space between the valve stem 15 and the annular wall 14*a*. As illustrated, the diameter of the cylinder 14 below the annular wall 14*a* is smaller than the diameter above it. This is because the upper part of the cylinder is dimensioned to fit an off-the-shelf solenoid coil and the lower part is dimensioned to restrict the flow of liquid so that it does not exit the spout too quickly. As seen in FIGS. 4 and 6, the interior of the spout 14*b* is chamfered so that it makes a good seal with the conical sealing valve 26.

A rectangular opening 28 (seen best in FIG. 7) extends through the fluid passage between the two cylinders 12, 14. A rectangular pushbutton 30 is disposed inside the rectangular opening 28 with the rectangular pushbutton 30 extending out of the rectangular opening behind the spout 14*b* (seen best in FIGS. 1, 2, and 4-6). As seen best in FIG. 7, the pushbutton 30 has a T-shaped profile which prevents it from falling through the opening 28. A normally-off microswitch 32 is disposed above the pushbutton 30. The microswitch 32 is coupled to a battery compartment 34 which is arranged on top of the fluid passage 16 between the two cylinders 12, 14. The batteries 36*a-d* are coupled via contacts 38*a-f* and wires 40*a-d* (FIG. 7) through the normally-off microswitch 32 to the solenoid coil 18. A slot 14*c* (FIG. 7) in the upper portion of the cylinder 14 facilitates the passage of wires to the coil 18.

Figures 1, 2, 3:
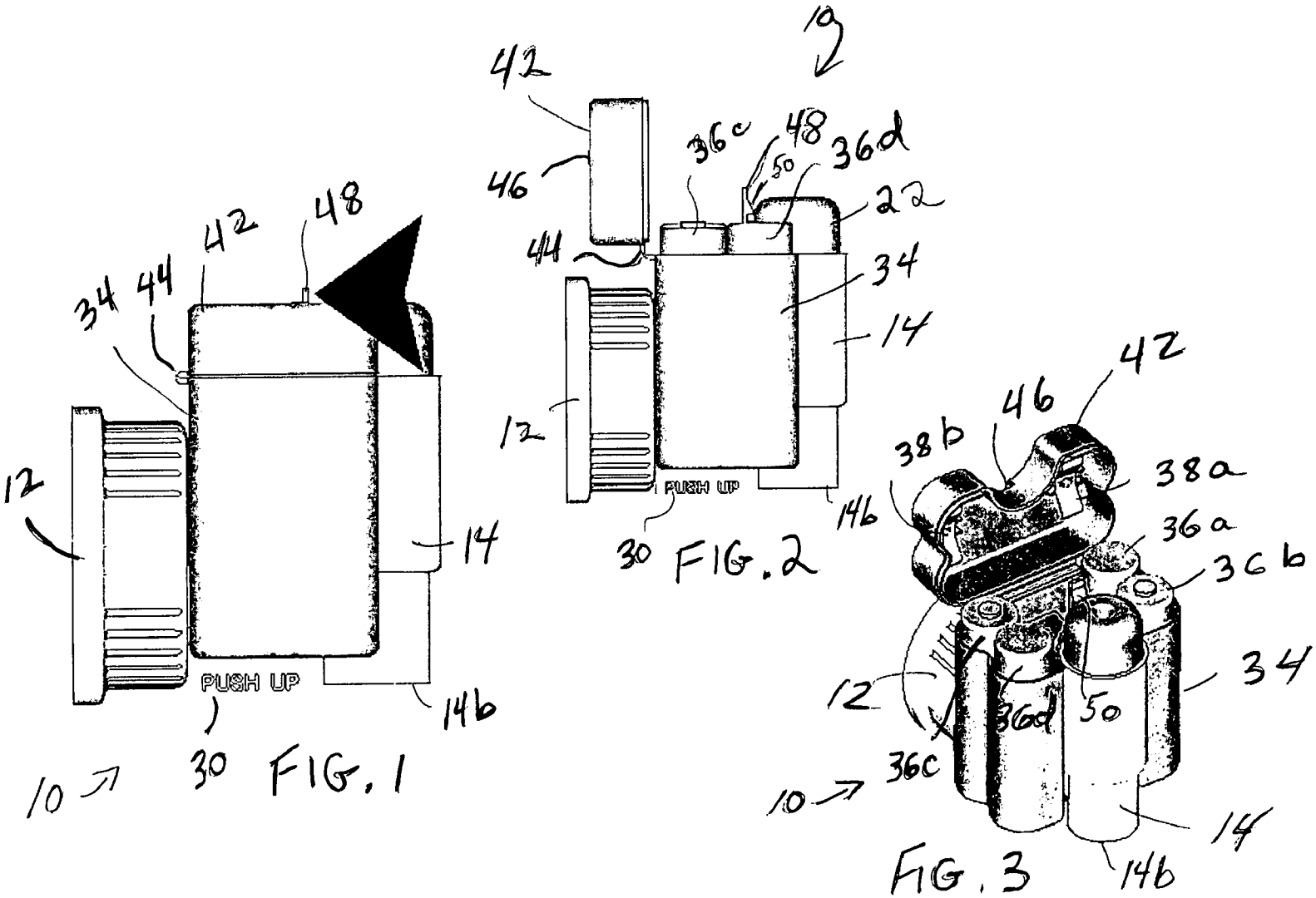
FIG. 1 is a side elevation view of a dispenser according to the invention.
FIG. 2 is a view similar to FIG. 1 but with the battery compartment open.
FIG. 3 is a perspective view of the dispenser with the battery compartment open.

As seen best in FIGS. 1-3, the battery compartment 34 has a cover 42 which is coupled to the compartment by a live hinge 44. A latch opening 46 is centrally located on the cover. A flexible latch 48 is centrally located in the battery compartment as seen best in FIGS. 2 and 3. The latch has a barb 50 which engages the opening 46 to hold the cover shut. Pushing the latch 48 in the direction of the arrow in FIG. 1 releases the cover. It should be noted that the battery compartment cover is dimensioned such that when it is opened, the tops of the batteries are exposed as seen in FIGS. 2 and 3. This permits easy access to the batteries.

Figure 5:
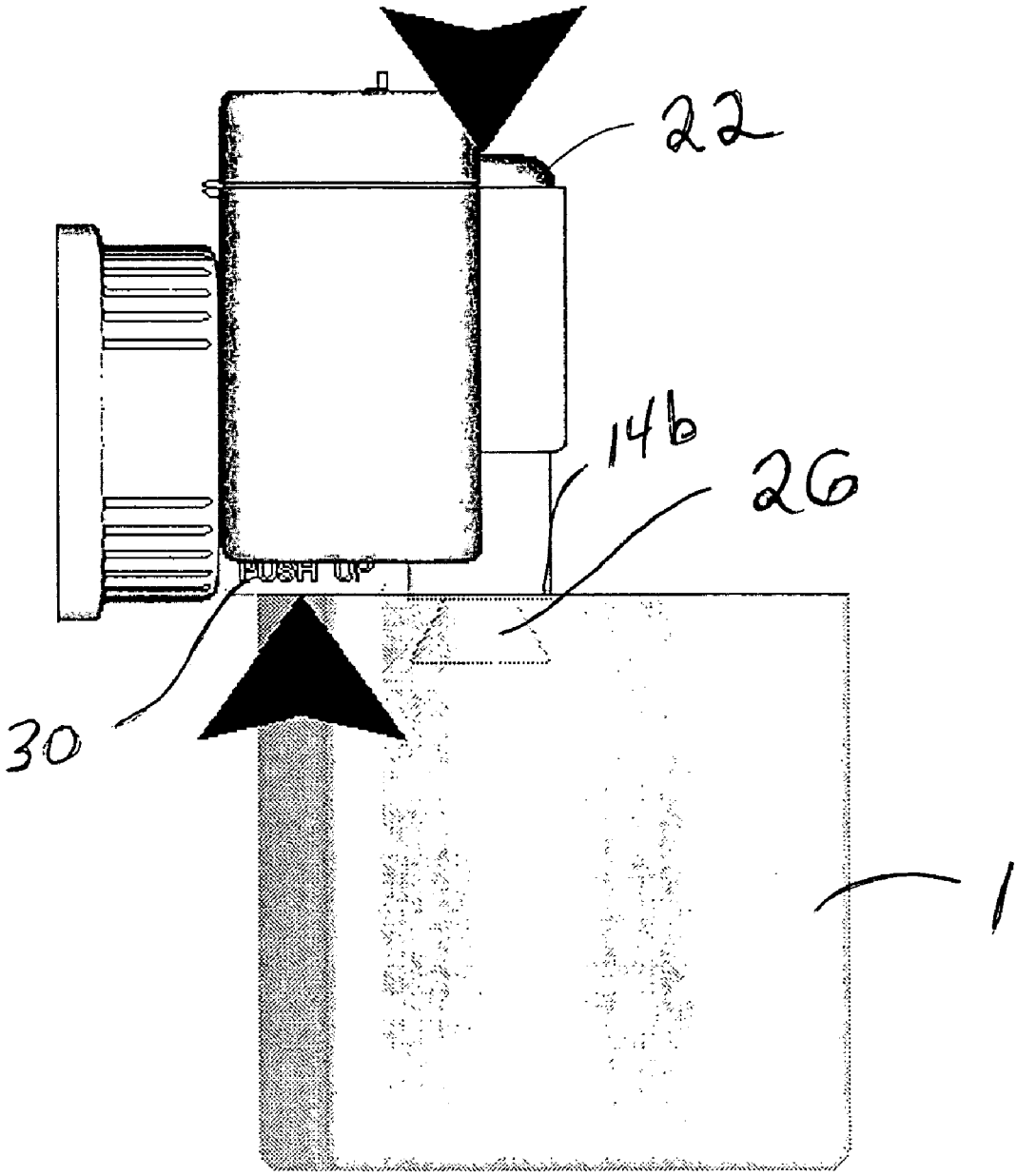
FIG. 5 is a partially transparent side elevation view of the dispenser and a cup with the valve open.

As shown in FIGS. 5 and 6, to use the dispenser, one holds a cup 1 under the spout 14*b* and lifts the cup vertically until the lip of the cup presses the rectangular pushbutton 30 up activating the microswitch. The microswitch 32 closes the circuit between the batteries and the solenoid coil 18. With current flowing through the coil, a magnetic field is created with poles opposite to the poles of the magnetic armature. This causes the armature 20 to move down against the coil spring 24, thereby moving the conical valve seal 26 away from the bottom of the cylinder 14 and allowing liquid to exit the spout 14*b* under the action of gravity. When the cup 1 is moved vertically down away for the rectangular pushbutton 30, the microswitch 32 opens the circuit, the solenoid coil 18 is deactivated and the coil spring 24 returns the conical seal 26 back to the closed position preventing liquid flow.

Any time, if desired, or if the batteries become too weak to power the solenoid, the dispenser can be manually actuated, albeit with two hands rather than one, by using the cylindrical pushbutton 22. Pushing the pushbutton 22 causes the armature 20 to move down against the spring, thereby moving the conical valve seal 26 away from the bottom of the cylinder 14 and allowing liquid to exit the spout 14*b* under the action of gravity. Releasing the pushbutton permits the spring to move the pushbutton, armature, and valve seal back to their original position, thereby closing the valve.

As described above, the dispenser according to the invention is intended to be used with large jugs of liquid such as laundry detergent which will be sold with the dispenser attached with batteries loaded. In order to prevent the dispenser from being accidentally operated during the transit from the factory to the consumer, a cover is provided. FIGS. 8 and 9 show a suitable cover 50. The cover 50 is preferably marked so that it may be used as a measuring cup. The cover (cup) is preferably translucent and marked with fill lines which are labeled, for example, "large load", "medium load", "small load". Thus, when the user lifts the cup under the spout activating the microswitch, the translucency of the cup allows the user to see the liquid rise against the fill lines. When the liquid is at the desired level, the cup can be lowered thereby deactivating the microswitch and stopping the flow. In the manual mode, the user can release the cylindrical pushbutton when the desired liquid level is observed.

There have been described and illustrated herein a battery powered solenoid actuated liquid tap dispenser having a manual actuator as well. While a particular embodiment of the invention has been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A battery powered liquid tap dispenser, comprising:

a spout;

a solenoid coil;

an armature extending through said coil, said armature having first and second ends;

a valve seal coupled to said second end of said armature;

a manually operable pushbutton coupled to said first end of said armature and being manually operable to open said valve seal without energizing said solenoid coil;

a substantially vertical cylinder having a first end and a second end, said second end forming said spout, said valve seal movable against and away from said spout, said pushbutton extending out of said first end of said cylinder; and a substantially horizontal cylinder in fluid communication with said substantially vertical cylinder, said substantially horizontal cylinder adapted to be coupled to a standard size liquid jug.

2. The dispenser according to claim 1, further comprising:

a battery compartment located between said substantially horizontal cylinder and said substantially horizontal cylinder.

3. The dispenser according to claim 1, wherein:

said substantially vertical cylinder has an interior annular wall, and said coil is seated on said annular wall with said armature extending into the cylindrical space defined by said annular wall.

4. The dispenser according to claim 3, wherein:

said valve seal has a valve stem and said valve stem is coupled to said armature.

5. The dispenser according to claim 4, wherein:

said valve stem is provided with a dynamic seal.

6. The dispenser according to claim 1, further comprising:

an electrical switch; and a power supply, said electrical switch being coupled between said power supply and said solenoid coil such that actuation of said switch applies current to said coil and causes said armature to open said valve seal.

7. The dispenser according to claim 6, wherein:

said electrical switch is located relative to said spout such that it is actuated by an upward movement of the lip of a cup under said spout.

* * * * *